US007223145B2

(12) United States Patent
Okazaki et al.

(10) Patent No.: US 7,223,145 B2
(45) Date of Patent: May 29, 2007

(54) FLUORESCENT LAMP HAVING MEANDERING DISCHARGE PATH AND MANUFACTURING METHOD OF THE SAME

(75) Inventors: Yusuke Okazaki, Ibaraki (JP); Nobutaka Ota, Wake-gun (JP); Toshiyuki Namura, Tatsuno (JP); Akio Kitada, Hirakata (JP); Tadashi Shimizu, Hamura (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 96 days.

(21) Appl. No.: 11/203,825

(22) Filed: Aug. 15, 2005

(65) Prior Publication Data

US 2006/0030233 A1 Feb. 9, 2006

Related U.S. Application Data

(62) Division of application No. 10/731,037, filed on Dec. 9, 2003, now Pat. No. 7,009,334.

(30) Foreign Application Priority Data

Dec. 16, 2002 (JP) ..... 2002-364388

(51) Int. Cl.
*H01J 9/26* (2006.01)

(52) U.S. Cl. ..... 445/22; 445/26

(58) Field of Classification Search ..... None
See application file for complete search history.

(56) References Cited

U.S. PATENT DOCUMENTS 5,090,931 A * 2/1992 Shiraishi ..... 445/22
5,896,003 A * 4/1999 Gehring ..... 445/26
6,148,638 A * 11/2000 Oga et al. ..... 65/59.2

FOREIGN PATENT DOCUMENTS

JP 62090844 4/1987
JP 62278749 12/1987
JP 63128662 8/1988

* cited by examiner

*Primary Examiner*—Ashok Patel

(57) ABSTRACT

An object of the present invention is to provide, without increasing the costs or decreasing the quantity of light, a fluorescent lamp that is less likely to have the bridge and the constituent tubes damaged while being handled and has improved handleability, as well as to provide a manufacturing method therefor. It is arranged so that the distance between the first and second constituent tubes gradually becomes smaller from the base side of the lamp toward the turning portion side of the lamp where the discharge paths turn. It is arranged so that the value of D2/D1 is within a range of 0.05 to 0.70 inclusive, where D1 is the distance between the first and second constituent tubes being measured at the bridge connecting points on the base side, and D2 is the shortest distance between the first and second constituent tubes on the turning portion side.

5 Claims, 7 Drawing Sheets

FLUORESCENT LAMP HAVING MEANDERING DISCHARGE PATH AND MANUFACTURING METHOD OF THE SAME

CROSS-REFERENCE TO RELATED APPLICATIONS

This application is a divisional application of U.S. Ser. No. 10/731,037 filed on Dec. 9, 2003 now U.S. Pat. No. 7,009,334.

BACKGROUND OF THE INVENTION (1) Field of the Invention

The present invention relates to fluorescent lamps having meandering discharge paths and manufacturing methods of the same, particularly to a technique for improving handleability of fluorescent lamps especially during the installation process.

(2) Description of the Related Art

In recent years, single-based fluorescent lamps, or so-called compact fluorescent lamps, have been popularly used for their advantages in long lives and low electricity consumption.

In a compact fluorescent lamp, in order to keep it compact, a plurality of constituent tubes that each have a U-shaped discharge path are connected together, so as to form a tube with one meandering discharge path. More specifically, in order to form one meandering discharge path, the discharge paths of the constituent tubes are connected by one or more bridges, in such a way that an area in the vicinity of an end of a constituent tube is connected to an area in the vicinity of an end of another constituent tube, wherein each of these ends connected is one of the ends that are positioned opposite to the turning portion of each constituent tube. Also, in a compact fluorescent lamp, the constituent tubes connected in such a manner are disposed on a case so that the bridged portions are positioned close to the lamp base, and the turning portions are away from the lamp base. (For example, see the Japanese Unexamined Patent Application Publication No. 62-278749.) In the disclosure, on the turning portion side of the lamp, it is arranged so that the constituent tubes are disposed with a gap interposed therebetween.

When this kind of compact fluorescent lamp is to be inserted into a socket, people normally hold the vicinity of the turning portions of the constituent tubes (the side opposite to the case) by the hand. At this time, a compressive force is applied to the constituent tubes on the turning portion side of the lamp, and the distance between the constituent tubes becomes smaller at the areas with no bridge. Also, since a force is applied to the bridge provided on the base side, the bridge may be distorted, and there may be cracks between the bridge and the constituent tubes at their boundaries. In some cases, the constituent tubes themselves may be damaged or, for example, cracked.

In order to keep the lamps from being damaged during an installation process, the Japanese Unexamined Patent Application Publication No. 62-90844 discloses a technique for keeping the constituent tubes apart even when a compressive force is applied, by having an arrangement wherein (i) spacers are inserted between the constituent tubes at the tube extremities just for the purpose of installation, (ii) the fluorescent lamp is inserted into a socket while the spacers are still attached, and (iii) the spacers are taken out after the lamp is installed and before the lamp is driven for light emission.

The Japanese Unexamined Utility Model Application Publication No. 63-128662 discloses a technique for disposing tubes so that they lean toward each other when two or more V-shaped constituent tubes are attached to an installation base.

With the arrangement disclosed in the Japanese Unexamined Patent Application Publication No. 62-90844, although it is possible to keep the fluorescent lamp from being damaged during the process of inserting the lamp into a socket, it is necessary to provide the spacers, which are the parts that do not contribute to the original function of the fluorescent lamp i.e. to emit light. As a result, there are problems that the quantity of light is reduced, or the costs of the lamps become high.

With the arrangement disclosed in the Japanese Unexamined Patent Application Publication No. 63-128662, since the bridge is stored below the surface level of the case, the lamp is free from the problem of having the bridge damaged; however, since the V-shaped constituent tubes are used, it is required that the surface area of the holder to which the constituent tubes are attached should be large, and the fluorescent lamp is less advantageous in terms of its compactness. It is inevitable that the vessel in which the fluorescent lamp is to be disposed also has large capacity, and it is disadvantageous in terms of the cost. In addition, since the only arrangement made is that the constituent tubes are disposed so that they lean toward each other, it is not possible to completely keep the bridge and the constituent tubes from being damaged.

Further, with the arrangement disclosed in the Japanese Unexamined Patent Application Publication No. 63-128662, since the bridge is stored inside the case, parts of the tubes in the vicinity of the bridge are also stored in the case. As a result, the quantity of light is reduced as much.

SUMMARY OF THE INVENTION

The present invention aims to solve these problems, and an object of the present invention is to provide a fluorescent lamp whose bridge and tubes are less likely to be damaged while being handled, and whose handleability is improved without a cost increase, as well as to provide a manufacturing method of the same.

In order to achieve the object, the present invention provides a fluorescent lamp comprising: a base; a first constituent tube that has a U-shaped discharge path and is disposed so that a first end and a second end thereof are positioned on the base side of the fluorescent lamp, and a turning portion thereof where the discharge path turns is positioned away from the base; a second constituent tube that has a U-shaped discharge path and is disposed so that a third end and a fourth end thereof are positioned on the base side of the fluorescent lamp, and a turning portion thereof where the discharge path turns is positioned away from the base; and a bridge that connects a first area in a vicinity of the first end of the first constituent tube with a second area in a vicinity of the third end of the second constituent tube so as to join the two discharge paths, wherein distances between the first constituent tube and the second constituent tube gradually become smaller from the base side toward the turning portion side of the fluorescent lamp, and D2/D1 is within a range of 0.05 to 0.70 inclusive, where D1 is a distance between (a) a point closest to the base within the first area and (b) a point closest to the base within the second area, and D2 is a shortest distance, on the turning portion side of the fluorescent lamp, between the first constituent tube and the second constituent tube.

With this arrangement wherein the value of D2/D1 is arranged to be 0.70 or smaller, even if the first constituent tube and the second constituent tube are held together by hand on the turning portion side of the lamp during an installation process of the lamp, stress can be relaxed before the bridge and the constituent tubes are damaged, when the external surfaces of the constituent tubes come in contact with each other at the D2 defining points because of flexibility each constituent tube has.

Also, in this arrangement, the value of D2/D1 is arranged to be 0.05 or larger. This arrangement is made in order to prevent the distance between the first constituent tube and the second constituent tube from being too large on the base side where they are connected with each other by the bridge, and to maintain the compactness of the lamp. As additional information, generally speaking, in some fluorescent lamps, metal mercury vapor, along with a rare gas, is enclosed in the discharge paths, and the coldest-point control method is used to control the vapor pressure. In such cases, when the value of D2/D1 is arranged to be 0.05 or larger, it is possible to avoid that the external surfaces (i.e. the coldest points) of the constituent tubes come in contact with each other, while compactness of the lamp is still maintained. Thus, even when the coldest-point control method is used, the luminous flux does not decrease. In other words, in a case of a fluorescent lamp in which the coldest-point control method is used to control the vapor pressure, when the external surfaces of the first and second constituent tubes are in contact with each other, the luminous flux decreases due to a rise in the temperature caused by light emission; however, when the value of D2/D1 is arranged to be over 0.05 or larger so that the external surfaces of the constituent tubes are apart from each other at the D2 defining points in the vicinity of the turning portions, it is possible to keep the quantity of light high.

Accordingly, in order to install the fluorescent lamp of the present invention, without having a spacer inserted for the purpose of installation between the turning portions of the first constituent tube and the second constituent tube, it is possible to prevent the bridge and constituent tubes from being damaged. Thus, it is possible to provide a fluorescent lamp that has improved handleability, large quantity of light, and compactness, without having an increase in the costs.

It should be noted that, although it has been mentioned that the first constituent tube and the second constituent tube are both disposed on the same base so that the ends are positioned on the base side of the lamp, it does not necessarily mean that the first and second constituent tubes should be disposed on a same plane. The expression above is conceptual and used for a mere purpose of showing the positional relation between the constituent tubes.

In the fluorescent lamp with the aforementioned arrangement, the value of D2/D1 is calculated while the first and second constituent tubes do not receive stress from other things, in other words, calculated at a time when a spacer, like the one disclosed in the Japanese Unexamined Patent Application Publication No. 62-90844, is not inserted between the first and second constituent tubes.

Additionally, it is also acceptable if the fluorescent lamp of the present invention comprises three or more constituent tubes.

There are fluorescent lamps in various sizes having been manufactured and used. It is possible to apply the present invention to a fluorescent lamp with an arrangement wherein in each of the first constituent tube and the second constituent tube, a straight-line distance between the point at which D1 is measured and a point at which D2 is measured is within a range of 50 mm to 200 mm inclusive.

With an arrangement wherein a first imaginary line and a second imaginary line cross at an angle that is within a range of 0.4 to 3.0 degrees inclusive, where the first imaginary line is a straight line that connects two points in the first constituent tube at which D1 and D2 are measured respectively, and the second imaginary line is a straight line that connects two points in the second constituent tube at which D1 and D2 are measured respectively, it is possible to prevent the bridge and the constituent tubes from being damaged when a compressive force is applied to the first and second constituent tubes on the turning portion side of the lamp, to keep the quantity of light large, and to maintain compactness of the lamp.

The present invention is especially effective with a fluorescent lamp wherein the first and second ends of the first constituent tube and the third and fourth ends of the second constituent tube are at least partially cased inside the base, for example, a compact single-based fluorescent lamp.

The present invention also provides a fluorescent lamp comprising: a base; a first constituent tube that has a U-shaped discharge path and is disposed on the base so that a first end and a second end thereof are positioned on the base side of the fluorescent lamp, and a turning portion thereof where the discharge path turns is positioned away from the base; a second constituent tube that has a U-shaped discharge path and is disposed on the base so that a third end and a fourth end thereof are positioned on the base side of the fluorescent lamp, and a turning portion thereof where the discharge path turns is positioned away from the base; and a bridge that connects a first area in a vicinity of the first end of the first constituent tube with a second area in a vicinity of the third end of the second constituent tube so as to join the discharge paths, wherein distances between the first constituent tube and the second constituent tube gradually become smaller from the base side toward the turning portion side of the fluorescent lamp, and external surfaces of the first constituent tube and the second constituent tube are in contact with each other on the turning portion side of the fluorescent lamp.

It is possible to apply this arrangement to a fluorescent lamp in which amalgam is enclosed in the discharge path and the amalgam control method is used to control the vapor pressure. With this arrangement, since the external surfaces of the first and second constituent tubes are in contact with each other on the turning portion side of the lamp, it is possible to prevent the bridge and the constituent tubes from being damaged during the process of installing the lamp. In addition, when the amalgam control method is used to control the vapor pressure of the fluorescent lamp, it is possible to prevent the luminous flux from decreasing and to keep the quantity of light large.

Accordingly, a fluorescent lamp with the aforementioned arrangement is able to achieve, even with higher certainty, such effects as (i) preventing the bridge and the constituent tubes from being damaged by a compressive stress applied on the first and second constituent tubes in the vicinity of the turning portions (i.e. in the vicinity of the extremity of the lamp) and (ii) keeping the quantity of light large.

The present invention further provides a manufacturing method of a fluorescent lamp, comprising: a hole opening step of opening holes, by melting with heat, each in an area in a vicinity of a first end of a first constituent tube and in an area in a vicinity of a second end of a second constituent tube, the first and second constituent tubes each having a U-shaped discharge path; a joining step of joining, after the hole opening step is performed, a first melted area formed around the hole in the first constituent tube with a second melted area formed around the hole in the second constituent tube; a distance adjusting step of adjusting D1 and D2 so that D2/D1 is within a range of 0.05 to 0.70 inclusive, where D1 is a distance between the first melted area in the first constituent tube and the second melted area in the second constituent tube, and D2 is a shortest distance, on a turning portion side of the fluorescent lamp, between the first constituent tube and the constituent tube, the turning portion being where each U-shaped discharge path turns; and a holding step of holding, after the distance adjusting step is performed, the first and second constituent tubes until the first and second melted areas have a temperature that is equal to or colder than a strain point of a glass material of which the constituent tubes are made.

According to the manufacturing method with this arrangement, after the joining step is performed, the distance adjusting step and the holding step are performed before the temperature of the melted areas reaches the strain point of the glass; therefore, it is possible to manufacture, with a high yield, a fluorescent lamp in which the value of D2/D1 is arranged to be within the predetermined range.

In addition, the fluorescent lamp manufactured according to this manufacturing method is advantageous in terms of both costs and handleability, since the bridge and the constituent tubes will not be damaged during the installation process, even if a spacer for the purpose of installation is not inserted at the D2 defining points.

Thus, according to the manufacturing method of the present invention, it is possible to obtain a fluorescent lamp whose cost is lower and whose handleability is improved.

The manufacturing method may have an arrangement wherein in the distance adjusting step, (i) a first spacer whose thickness is substantially equal to D1 is inserted between the first constituent tube and the second constituent tube at a point where D1 is measured, and (ii) a second spacer whose thickness is substantially equal to D1 is inserted between the first constituent tube and the second constituent tube at a point where D2 is measured. Other arrangements are also acceptable, but this arrangement is effective in terms of manufacturing costs and accuracy.

The manufacturing method may have an arrangement wherein the first spacer and the second spacer are each made of either copper or a copper alloy. This arrangement is made in consideration of the heat applied and protection of the constituent tubes against damage during different steps of manufacturing.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

Structure of the Fluorescent Lamp 1

Figure 1:
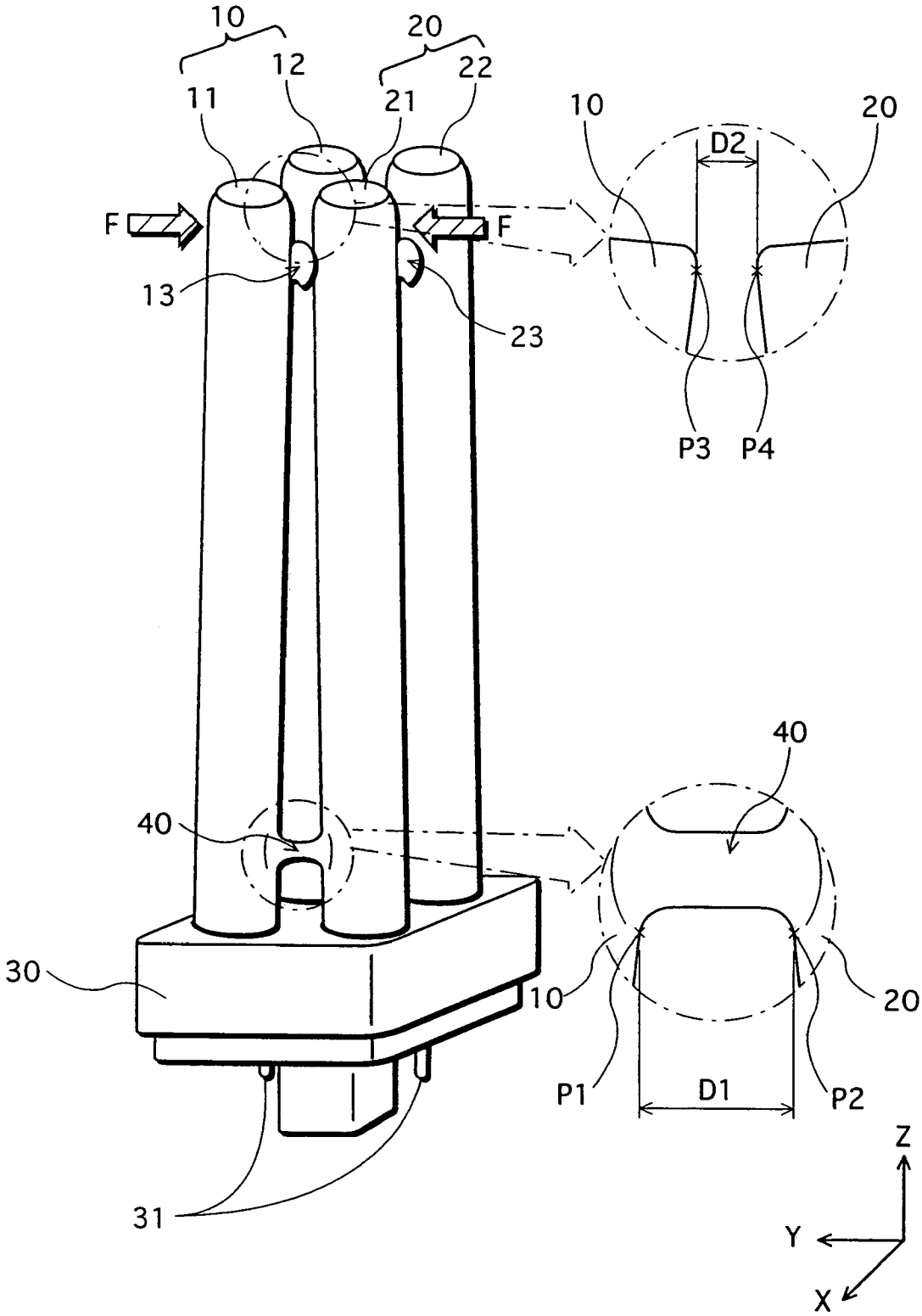
FIG. 1 is a perspective view of the fluorescent lamp 1 of an embodiment of the present invention.

The following explains the structure of the compact fluorescent lamp (hereafter, simply referred to as the "fluorescent lamp") 1 of an embodiment of the present invention, with reference to FIG. 1.

As shown in FIG. 1, the fluorescent lamp 1 is a single-based lamp in which a constituent lamp 10 and a constituent lamp 20 that each have a U-shaped discharge path are connected with each other at the bottom thereof in the z direction in the drawing by an inter-constituent bridge 40 and are disposed on the case 30. In this structure, the constituent tube 10 and the constituent tube 20 are arranged in series so that they are adjacent to each other on the turning portion side, where the side of the lamp on which the discharge paths turn is referred to as "the turning portion side", and the opposite side is referred to as "the base side".

A U-shaped discharge path means that the discharge path of each of the constituent tubes 10 and 20 turns at somewhere near the middle thereof, so that the discharge paths before the turning point and after the turning point are arranged substantially in parallel.

As shown in FIG. 1, the inter-constituent bridge 40 is disposed outside the case 30. This arrangement is made so that the lamp efficiency is kept high by maximizing the length of the discharge paths exposed on the outside of the case 30.

The constituent tube 10 is made up of a straight portion 11 and a straight portion 12, which are connected with each other at the top thereof in the z direction in the drawing by an intra-constituent bridge 13 so that the discharge paths of the straight portion 11 and the straight portion 12 are joined to form one discharge path. As a result, a U-shaped discharge path is formed (not shown in the drawing). The intra-constituent bridge 13 is provided in the vicinity of the turning portion of the constituent tube 10, and that is where the discharge path turns. Some parts of the constituent tube 10 are positioned above the intra-constituent bridge 13 in the z direction, and these parts are called the coldest points of the constituent tube 10. Electrodes (not shown in the drawing) are provided at the bottom in the z direction of the straight portion 12.

Like the constituent tube 10, the constituent tube 20 is made up of a straight portion 21 and a straight portion 22, which are connected with each other by the intra-constituent bridge 23 so that their discharge paths are joined to form one discharge path. Also, in the constituent tube 20, the intra-constituent bridge 23 is provided in the vicinity of the turning portion of the constituent tube 20, and that is where the discharge path turns and called the coldest points. Electrodes (not shown in the drawing) are also provided at the bottom in the z direction of the straight portion 22.

The straight portions 11, 12, 21, and 22 are each a glass tube whose outside diameter is within a range of 5 mm to 20 mm inclusive.

In the fluorescent lamp 1, the straight portions 11 and 12 of the constituent tube 10 and the straight portions 21 and 22 of the constituent tube 20 are connected by the intra-constituent bridges 13 and 23 and the inter-constituent bridge 40, so as to form one meandering discharge path.

Electrodes 31 are provided on a side (the bottom side in the drawing) of the case 30 being opposite to the side on which the constituent tubes 10 and 20 are disposed. Inside the case 30, the electrodes 31 are connected to the electrodes of the constituent tubes 10 and 20.

As shown in the close-up view at the bottom of FIG. 1, the distance between the external surfaces of the constituent tubes 10 and 20 as measured at the lowest points in the z direction of (i) the boundary between the inter-constituent bridge 40 and the constituent tubes 10 and (ii) the boundary between the inter-constituent bridge 40 and the constituent tube 20 will be referred to as D1. On the external surface of the straight portion 11 of the constituent tube 10, the point at which D1 is defined will be referred to as the point P1. On the external surface of the straight portion 21 of the constituent tube 20, the point at which D1 is defined will be referred to as the point P2. In other words, of various points on the boundaries between the inter-constituent bridge 40 and each of the constituent tubes 10 and 20, the points P1 and P2 are the points that are positioned closest to the base.

As shown in the close-up view at the top of FIG. 1, the distance between the constituent tube 10 and the constituent tube 20, as measured at a point in the upper area in the z direction of the drawing, where the distance is the shortest will be referred to as D2. On the external surface of the straight portion 11 of the constituent tube 10, the point at which D2 is defined (hereafter, it will be referred to as a D2 defining point) will be referred to as the point P3. On the external surface of the straight portion 21 of the constituent tube 20, the D2 defining point will be referred to as the point P4.

As for the constituent tube 10, it is arranged so that the straight-line distance between the point P1 and the point P3 in the straight portion 11 is within a range of 50 mm to 200 mm inclusive. In the same manner, as for the constituent tube 20, it is arranged so that the straight-line distance between the point P2 and the point P4 in the straight portion 21 is within a range of 50 mm to 200 mm inclusive.

As so far explained, in the fluorescent lamp 1 of the embodiment of the present invention, the constituent tubes 10 and 20 are disposed so that they lean toward each other in the y direction and the value of D2/D1 is within the range of 0.05 to 0.70 inclusive, where D1 and D2 are the distances defined above. With this arrangement, the distance between the straight portion 11 of the constituent tube 10 and the straight portion 21 of the constituent tube 20 is the largest on the base side of the fluorescent lamp and gradually becomes smaller toward the upper side in the z direction.

The distance between the straight portion 12 of the constituent tube 10 and the straight portion 22 of the constituent tube 20 also gradually becomes smaller toward the upper side in the z direction, just like the distance between the straight portion 11 of the constituent tube 10 and the straight portion 21 of the constituent tube 20. In other words, it is arranged so that the distance between the constituent tube 10 and the constituent tube 20 gradually becomes smaller from the base side of the lamp toward the turning portion side of the lamp.

Advantageous Features of the Fluorescent Lamp 1

In a case where a spacer is inserted between the constituent tube 10 and the constituent tube 20 in advance, like the fluorescent lamp disclosed in the Japanese Unexamined Patent Application Publication No. 62-90844, more parts and labor are required, and it is disadvantageous in terms of the cost. The spacer may also cause a reduction in the quantity of light.

In comparison with that, in the fluorescent lamp 1 with the aforementioned arrangement, since it is arranged so that the value of D2/D1 is 0.70 or smaller, the inter-constituent bridge 40 and the constituent tubes 10 and 20 do not get damaged during the installation process, even without having a spacer inserted between the constituent tube 10 and the constituent tube 20. In addition, in the fluorescent lamp 1, it is arranged so that the value of D2/D1 is 0.05 or larger, the distance between the constituent tube 10 and the constituent tube 20 in the vicinity of the inter-constituent bridge 40 (i.e. on the base side of the lamp) is not too large; therefore, the compactness of the lamp is not lost in practical use. Moreover, in the fluorescent lamp 1, since it is arranged so that the value of D2/D1 is 0.05 or larger, the coldest points of the constituent tubes 10 and 20 are not in contact with each other; therefore, the luminous flux will not decrease.

Additionally, since no spacers for installation are required with the fluorescent lamp 1, the cost of the lamp does not increase.

As a result, the fluorescent lamp 1 of the embodiment of the present invention is advantageous in terms of the cost and handleability and is able to keep the quantity of light large.

As a specific example, when the fluorescent lamp 1 is to be inserted into a socket, normally the fluorescent lamp 1 is held by the constituent tube 10 and the constituent tube 20 together around the D2 defining points (on the turning portion side) shown in FIG. 1. The constituent tubes 10 and 20 receive a force F at the D2 defining points. When such a force is applied, if there is no bridge provided where the force F is applied, for example, like in a conventional fluorescent lamp disclosed in the Japanese Unexamined Patent Application Publication No. 62-278749 wherein D2/D1=1.0, the compressive force F causes a large distortion in the bridge and the constituent tubes 10 and 20. Depending on the size of the force F applied, the bridge or the constituent tubes 10 and 20 may be damaged or, for example, cracked.

On the contrary, in the fluorescent lamp 1 of the embodiment, it is arranged so that the value of D2/D1 is 0.70 or smaller, the point P3 and the point P4 get in contact with each other before the inter-constituent bridge 40 or the constituent tubes 10 and 20 get damaged or, for example, cracked. As a result, the force F is distributed after the point P3 and the point P4 are in contact with each other, and thus the inter-constituent bridge 40 and the constituent tubes 10 and 20 will not be damaged by the force F applied during the actual installation process, for example, a force of approximately 200 N.

As additional information, when only improvement of handleability of the fluorescent lamp 1 needs to be achieved, it is also acceptable to have an arrangement wherein D2=0, i.e. the points P3 and P4 are already in contact with each other; however, in the fluorescent lamp 1 in which the coldest-point control method is used to control the vapor pressure, if the external surfaces of the constituent tubes 10 and 20 are in contact with each other at the coldest points being the D2 defining points, the lamp luminous flux will decrease. Consequently, in the present embodiment, it is arranged so that the value of D2/D1 is 0.05 or larger, and there is a gap between the point P3 and the point P4 when a force is not applied. In other words, in a case of a fluorescent in which the amalgam control method is used to control the vapor pressure, it is acceptable to have an arrangement wherein D2=0.

Manufacturing Method of the Fluorescent Lamp 1

The following explains the manufacturing method of the fluorescent lamp 1, with reference to FIGS. 2, 3A, 3B, 3C, 4A, 4B, and 4C. Of different stages of the manufacturing process of the fluorescent lamp 1, the following explanation focuses on the process of forming the inter-constituent bridge 40, which is one of the technical features of the fluorescent lamp 1 of the embodiment of the present invention.

Figure 2:
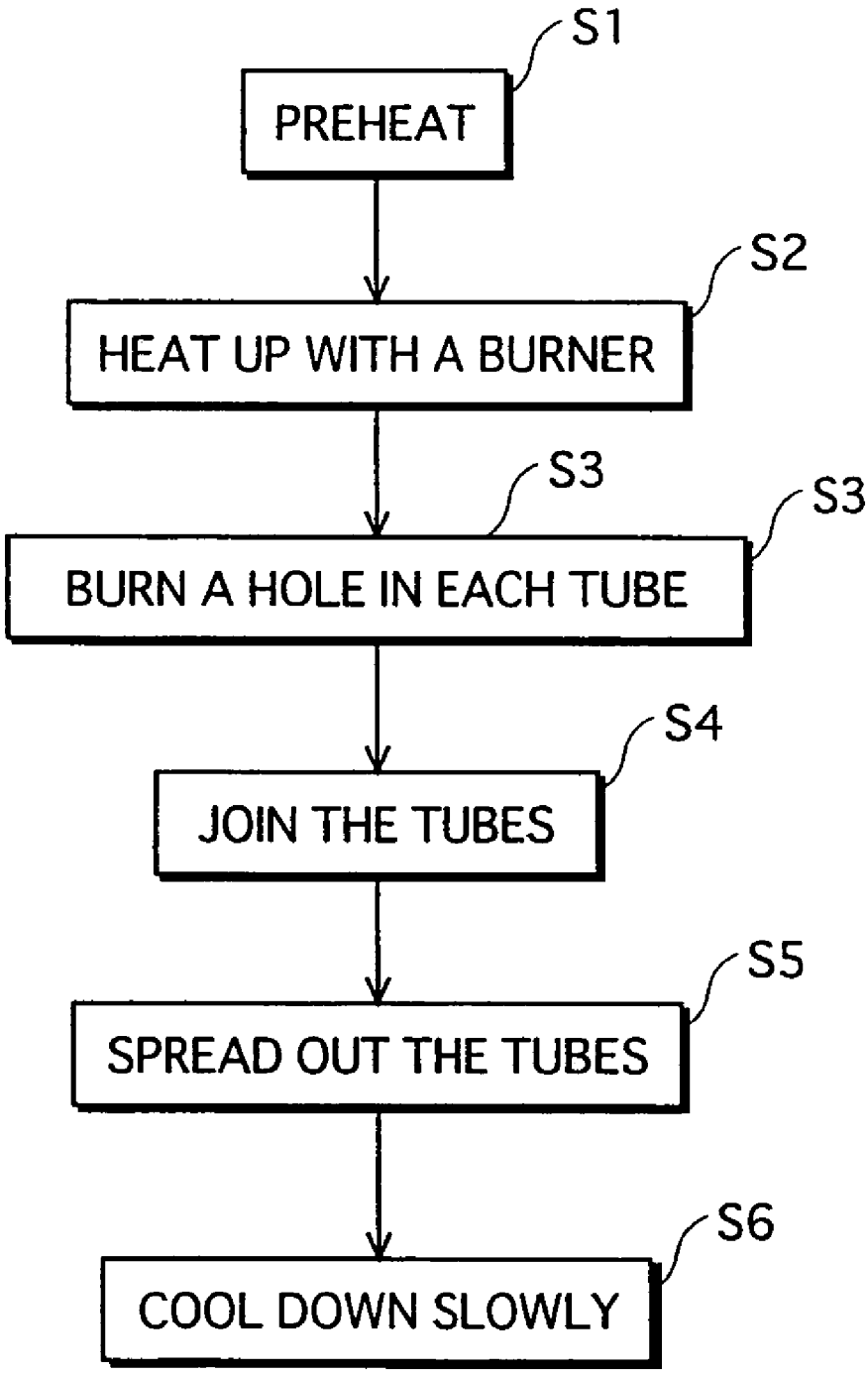
FIG. 2 is a flow chart that shows the process of connecting the glass tubes of the embodiment of the present invention.

As shown in FIGS. 2 and 3, the constituent tube 10 and the constituent tube 20 are preheated (Step S1 in FIG. 2), the constituent tube 10 including the straight portions 11 and 12 that are connected by the intra-constituent bridge 13; and the constituent tube 20 including the straight portions 21 and 22 that are connected by the intra-constituent bridge 23.

Figure 3C:
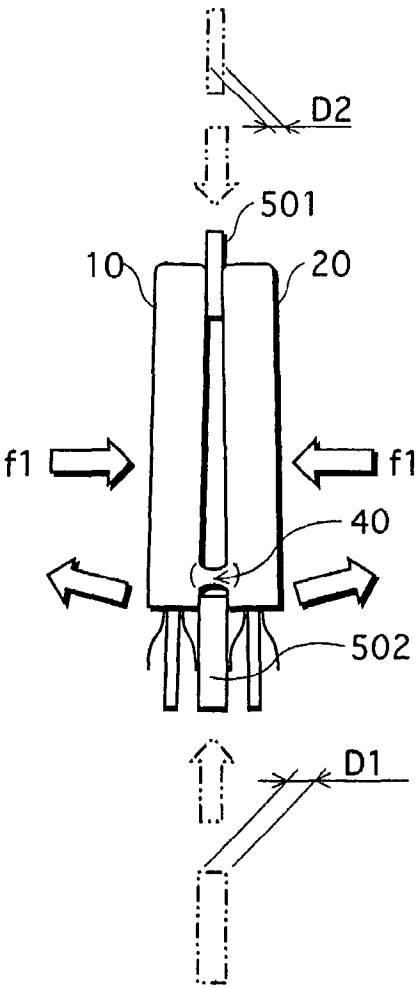
FIG. 3C shows the process of the distance adjusting step.
Figure 3B:
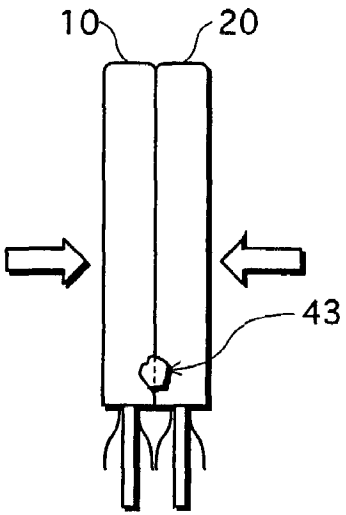
FIG. 3B shows the process of the joining step.
Figure 3A:
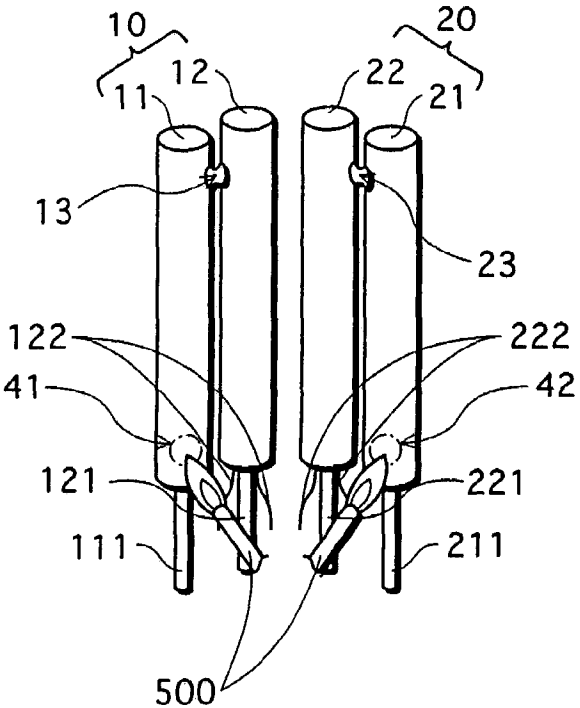
FIG. 3A shows the process of the hole burning step.

As shown in FIG. 3A, the exhaust tubes 111, 121, 211, and 221 extend from the bottoms of the straight portions 11, 12, 21, and 22, respectively. In addition, the lead wires 122 and 222 extend from the straight portions 12 and 22, respectively. The connection points 41 and 42 in the straight portions 11 and 21 respectively are heated by a burner 500 up to a temperature that is equal to or higher than the softening point of the glass material used (Step S2 in FIG. 2), so as to open holes (burn holes) each being positioned around the center of the connection point (Step S3 in FIG. 2).

Next, as shown in FIG. 3B, the constituent tube 10 and the constituent tube 20 are joined so that the connection point 41 having the hole made in Step S3 is in contact with the connection point 42 having the hole made in Step S3 (Step S4 in FIG. 2). When the constituent tubes 10 and 20 are joined, since the melted areas each at the hem of the hole are in contact with each other, the abutment 43 is formed.

It should be noted that, since the process up to this point is the same as the one in the prior art disclosed in the Japanese Unexamined Patent Application Publication No. 62-278749, description of detailed processing conditions will be omitted.

The following explains the processes from the step of adjusting the distance between the constituent tubes 10 and 20 (Step S5 in FIG. 2), which is one of the technical features of the embodiment of the present invention, through the step of cooling down slowly (Step S6 in FIG. 2).

As shown in FIG. 3C, two spacers 501 and 502, which are primarily made of a metallic material (for example, copper) or a heat-resistant resin, are inserted between the constituent tube 10 and the constituent tube 20, which are joined in Step S4 (Step S5 in FIG. 2). Of these two spacers, the spacer 502, whose width is D1, gets inserted between the tubes from the abutment 43 side. The spacer 502 gets inserted up to a point where the spacer 502 touches the outside of the abutment 43.

The spacer 501, whose width is D2, gets inserted between the tubes from a side of the tubes being opposite to the side from which the spacer 502 is inserted, namely the side that is in the vicinity of the areas connected by the intra-constituent bridges 13 and 23. The extent up to which the spacer 501 should be inserted does not need to be specified as clearly as the one for the spacer 502. It is acceptable if the spacer is inserted up to a point where the shortest distance between the constituent tube 10 and the constituent tube 20 is D2, as a result.

As shown in FIG. 3C, the forces f1 are applied to the constituent tubes 10 and 20 from the outside. The forces are applied in order to make sure that there are no gaps between the spacer 501 and the constituent tubes 10 and 20 as well as between the spacer 502 and the constituent tubes 10 and 20. More specifically, the forces f1 are applied using a chuck (not shown in the drawing) by which the constituent tubes 10 and 20 are held, starting from Step S1.

After Step S5 is performed, the constituent tubes 10 and 20 are then cooled down slowly to a temperature that is equal to or lower than the strain point of the glass material used, while the spacers 501 and 502 are still inserted, and the forces f1 are also applied with use of the chuck (Step S6 in FIG. 2).

Lastly, the spacers 501 and 502 are taken out from between the constituent tubes 10 and 20, and the forces f1 from the chuck is released. Thus, the process of joining the constituent tube 10 and the constituent tube 20 is completed, and the inter-constituent bridge 40 has been provided. At this time, by using the spacers 501 and 502 with the fluorescent lamp 1, it is possible to accurately adjust the distances D1 and D2.

Figure 4A:
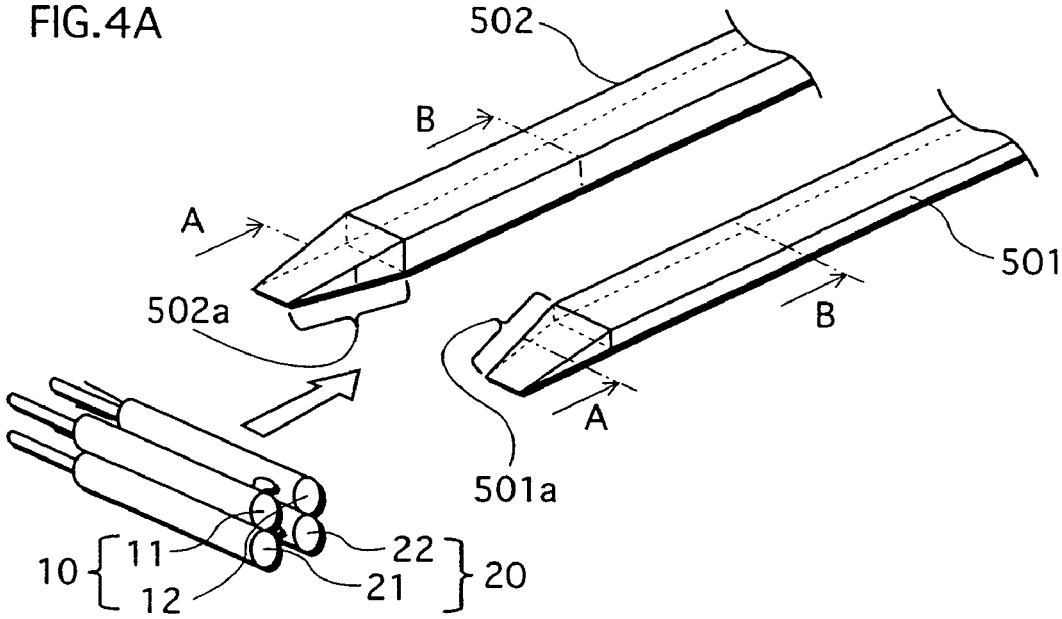
FIG. 4A shows the first stage of the distance adjusting step.
Figure 4B:
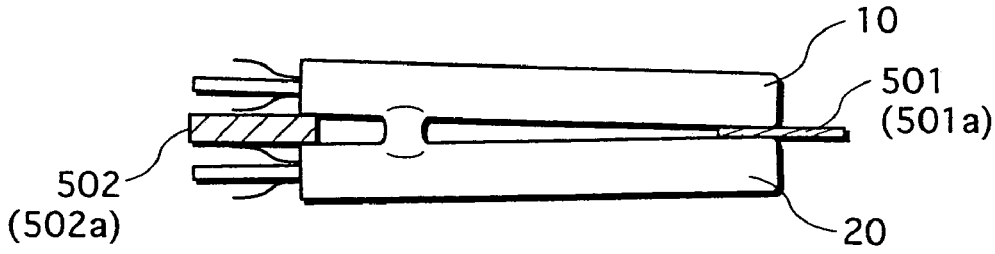
FIG. 4B shows the second stage of the distance adjusting step.
Figure 4C:
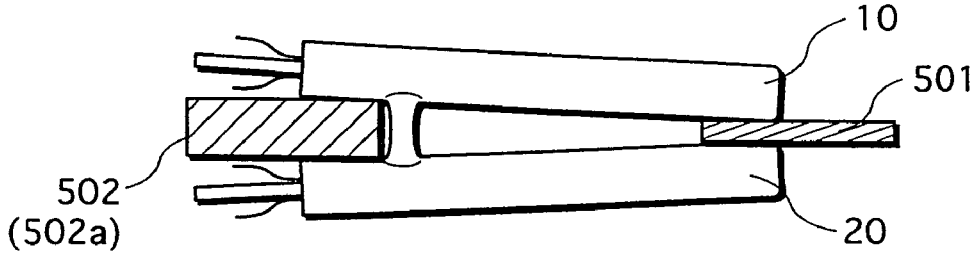
FIG. 4C shows the third stage of the distance adjusting step.

As for Step S5 shown in FIG. 3C, more detailed explanation will be provided, with reference to FIGS. 4A, 4B, and 4C. FIG. 4A shows parts of the apparatus that is used for the process of adjusting the distance between the constituent tubes 10 and 20 and is included in a revolving or non-revolving multi-head manufacturing machine.

As shown in FIG. 4A, the constituent tubes 10 and 20, which are joined in Step S4, are disposed being aligned in series so that they are partially fitted between the spacer 501 and the spacer 502. As mentioned earlier, the spacers 501 and 502 are primarily made of a metallic material or a heat-resistant resin, and are each shaped like a slender plate. A portion of each of the spacers 501 and 502, i.e. 501*a* and 502*a* into which the constituent tubes 10 and 20 are fitted, is tapered widthwise and thickness-wise.

FIG. 4B shows the positional relation when the constituent tubes 10 and 20 are fitted up to the A-A position shown in FIG. 4A. As shown in FIG. 4B, when the constituent tubes are fitted into the tapered portions 501*a* and 502*a* only a little bit, the spacers 501 and 502 are not yet inserted between the constituent tubes 10 and 20 up to the predetermined extent.

FIG. 4C shows the positional relation when the constituent tubes 10 and 20 are fitted up to the B-B position shown in FIG. 4A. At the stage shown in FIG. 4C, the constituent tubes 10 and 20 are disposed with a desired distance therebetween and desired leaning angles. In other words, at this stage, the constituent tubes 10 and 20 are disposed so that the distance between the point P1 and the point P2 is adjusted to be D1, and the distance between the point P3 and the point P4 is adjusted to be D2, shown in FIG. 1.

Although FIGS. 4A, 4B, and 4C, do not show the chuck that holds the constituent tubes 10 and 20, like in FIG. 3C, the constituent tubes 10 and 20 are held together to make sure that there are no gaps between the spacer 501 and the constituent tubes 10 and 20 as well as between the spacer 502 and the constituent tubes 10 and 20. While the positional relation is kept, the constituent tubes 10 and 20 are slowly cooled down to a temperature equal to or lower than the strain point of the glass material used, and then get separated from the spacers 501 and 502. In other words, the length of each of the spacers 501 and 502 is arranged so that the spacers 501 and 502 are inserted until the constituent tubes 10 and 20 have a temperature equal to or colder than the strain point of the glass material used, in consideration of the moving speed of the production line.

Using the manufacturing method mentioned so far, it is possible to manufacture the fluorescent lamp 1, which is less likely to be damaged at the inter-constituent bridge 40 and the constituent tubes 10 and 20, even when the force F is applied to the lamp during the installation process, as shown in FIG. 1.

MODIFICATION EXAMPLE

In the fluorescent lamp 1 shown in FIG. 1, it is arranged so that the value of D2/D1 is within the range of 0.05 to 0.70 inclusive, where D1 and D2 are each the distance between the constituent tube 10 and the constituent tube 20 being measured at a point on the upper side and a point on the lower side. In this modification example, it is possible to improve handleability of the fluorescent lamp by defining the leaning angle of the constituent tubes 10 and 20.

Figure 5:
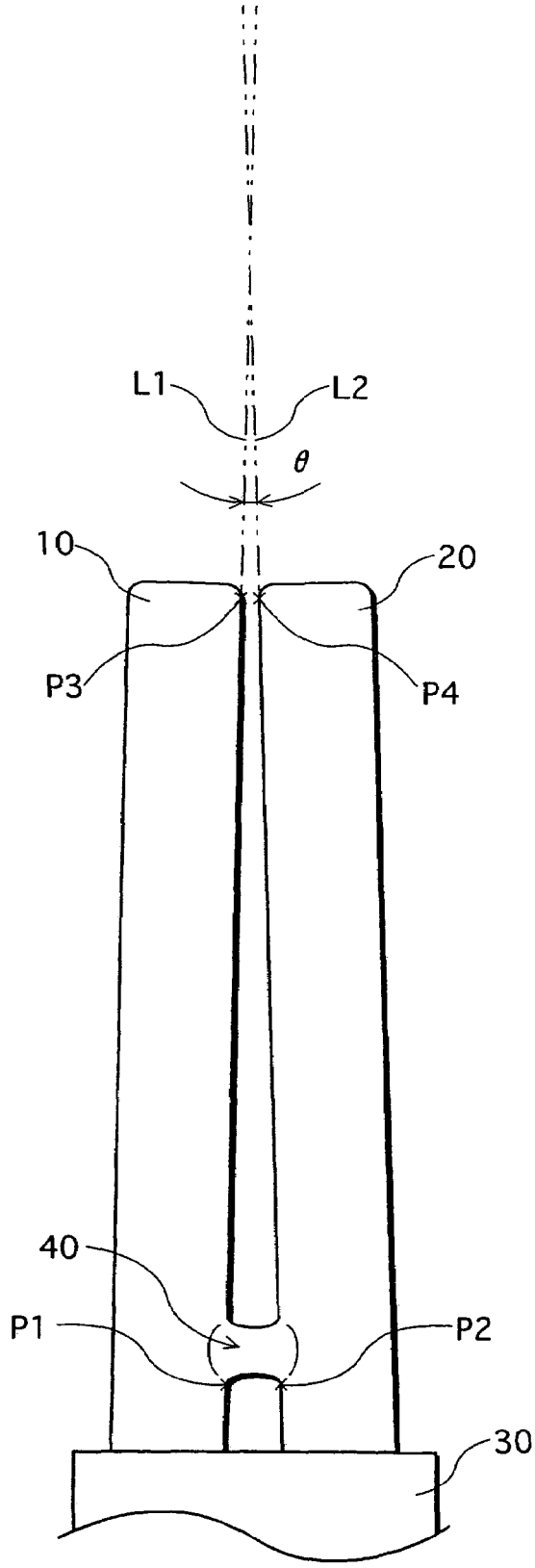
FIG. 5 is a plan view of the fluorescent lamp 1 of the embodiment of the present invention.

As shown in FIG. 5, an imaginary line L1 is drawn from the point P1 to the point P3 of the constituent tube 10. Likewise, another imaginary line L2 is drawn from the point P2 to the point P4 of the constituent tube 20.

The imaginary lines L1 and L2 cross at an angle θ (within a range of 0.4 to 3.0 degrees inclusive) on the upper side the fluorescent lamp.

In this fluorescent lamp, the positional relation between the constituent tube 10 and the constituent tube 20 with the angle θ can be arranged by the spacers 501 and 502 as shown in FIGS. 3C, 4B, and 4C, or alternatively by the chuck that holds the constituent tubes 10 and 20.

In a fluorescent lamp in which it is arranged so that the angle θ at which the imaginary lines L1 and L2 cross is 0.4 degrees or larger, as is the case with the fluorescent lamp 1, the inter-constituent bridge 40 and the constituent tubes 10 and 20 will not be damaged even when the force F is applied to the lamp as shown in FIG. 1. The mechanism for inhibiting lamp damage in this case is the same as the mechanism for inhibiting lamp damage in the fluorescent lamp 1.

Additionally, in the fluorescent lamp according to this modification example, since it is arranged so that the angle θ is 3.0 degrees or smaller, the distance between the constituent tube 10 and the constituent tube 20 is not too large on the inter-constituent 40 side; therefore, the compactness of the lamp is maintained. Furthermore, in the fluorescent lamp according to this modification example, since it is arranged so that the angle θ is 3.0 degrees or smaller, the coldest point of the constituent tube 10 is not in contact with the coldest point of the constituent tube 20 when an external force is not applied; therefore, even when the coldest point control method is used to control the vapor pressure in the fluorescent lamp, the quantity of light is not reduced.

Accordingly, as is the case with the fluorescent lamp 1 of the embodiment earlier mentioned, the fluorescent lamp of this modification example also has advantageous effects in terms of both the cost and the handleability, and achieves a large quantity of light and compactness.

Proof Tests

Figure 6:
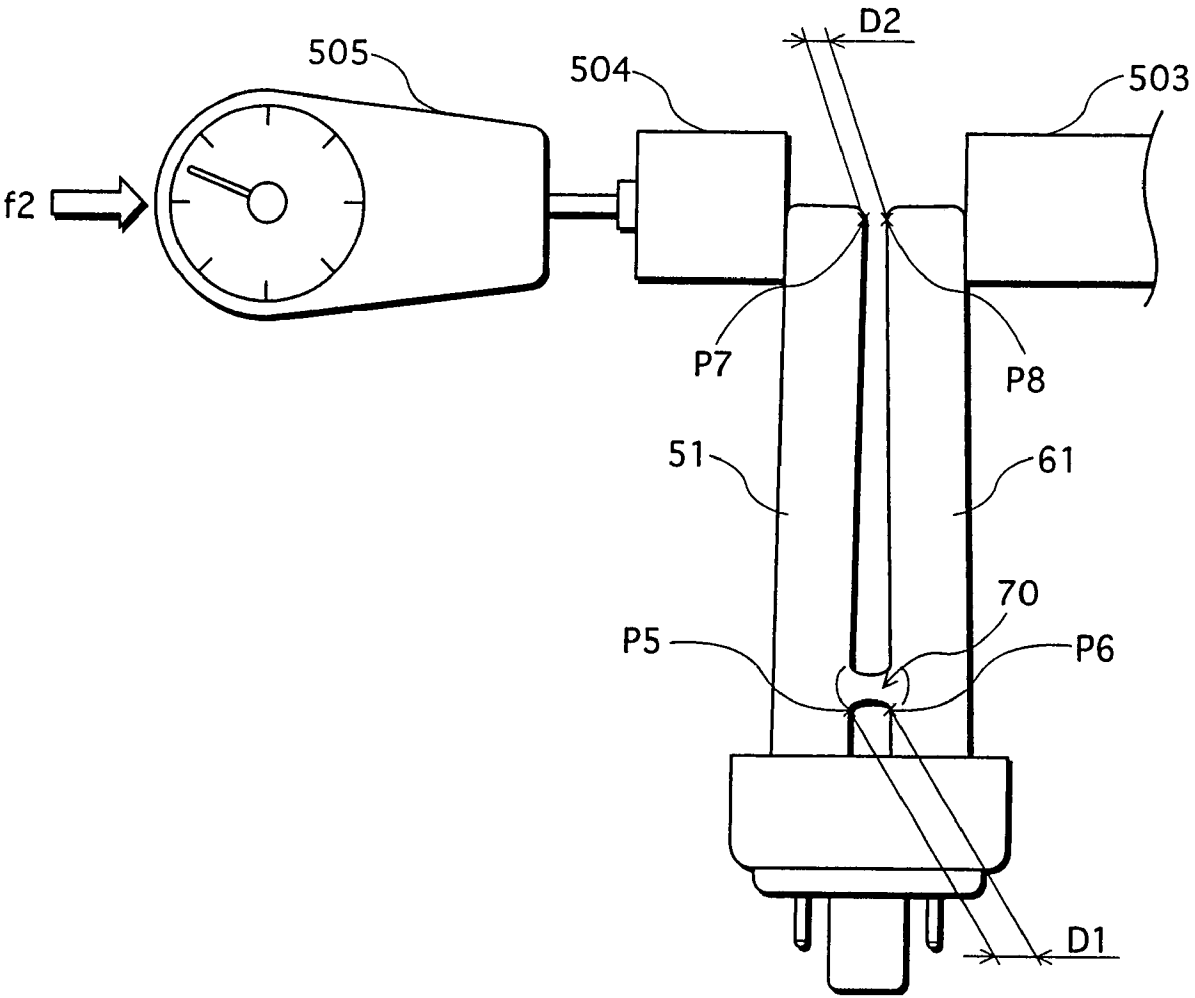
FIG. 6 shows the structure of the apparatus used in the proof tests.
Figure 7:
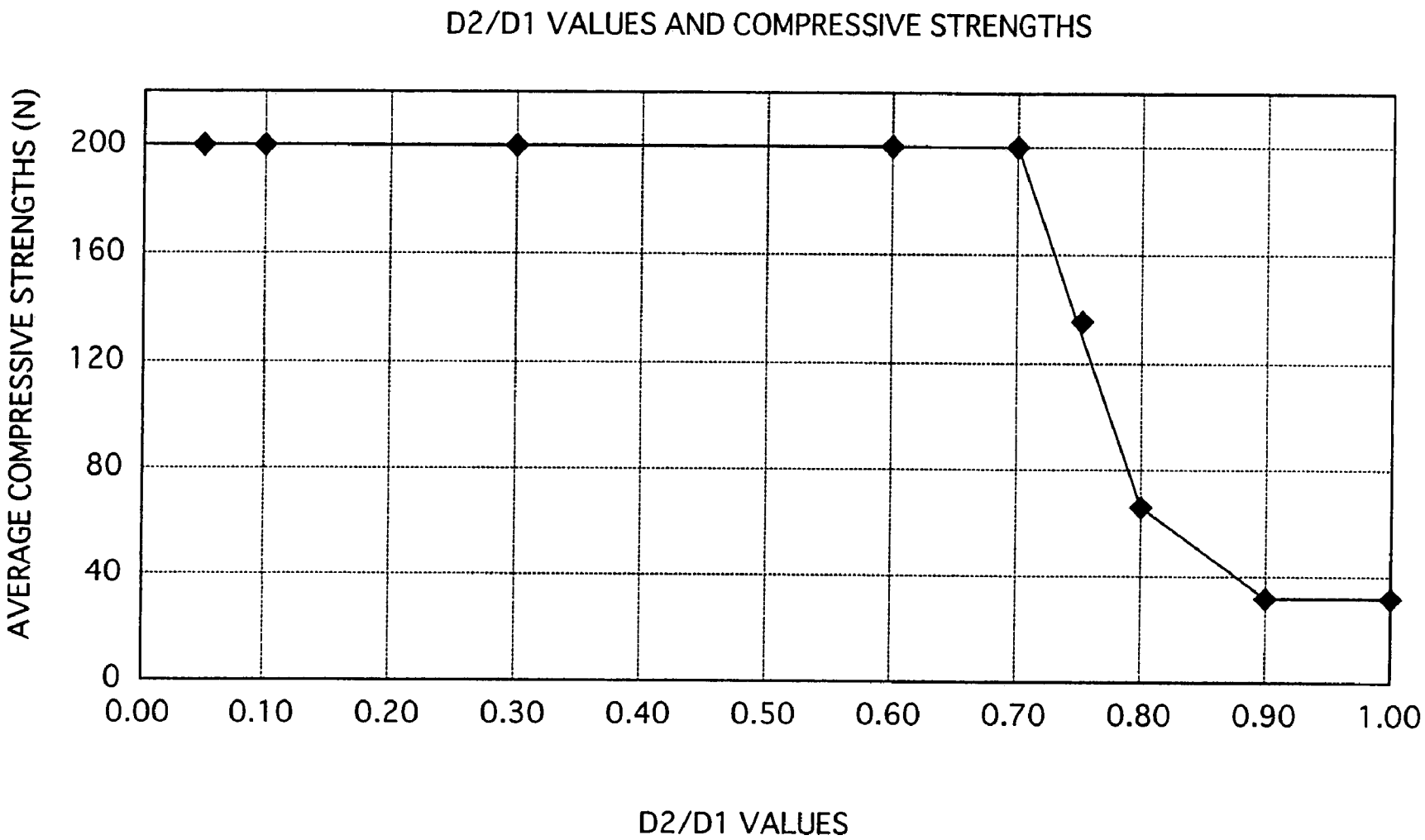
FIG. 7 is a chart that shows the correlation between the D2/D1 values and the compressive strengths.

The following describes the proof tests that were performed in order to confirm the effects of the aforementioned embodiment and modification example, with reference to FIGS. 6 and 7. FIG. 6 shows the general outline of the testing apparatus used in the proof tests. FIG. 7 summarizes the test results.

As shown in FIG. 6, in the testing apparatus, an end of the constituent tube 61 is in contact with the fixing board 503. A push-pull gage 505 is provided with the other constituent tube 51 with a padding board 504 intervening therebetween. A compressive force f2 was applied to the push-pull gage 505 in such a direction that shortens the distance D2 between the constituent tube 51 and the constituent tube 61. The levels of damage caused in the inter-constituent bridge 70 and the constituent tubes 51 and 61 were visually identified while the compressive force f2 were gradually increased.

The specification of the fluorescent lamps used in the tests was as follows:

Model of the fluorescent lamps: 13 W-type compact fluorescent lamps

Outside diameter of the straight portion: 12.5 mm

Distance between P5 and P7 (L1): 90 mm

Distance between P6 and P8 (L2): 90 mm

Distance D1: 2.0 mm

In order to perform the compression tests, five fluorescent lamp samples were prepared for each of nine different levels of the distance D2. The test results are shown in Table 1.

The correlation between the values of D2/D1 and the compressive strengths (the average values) is shown in FIG. 7.

TABLE 1

| Distance | | Angle θ | Compressive Strength (N) | | | | | | Number of Damaged |
|---|---|---|---|---|---|---|---|---|---|
| D2 (mm) | D2/D1 | (degrees) | 1 | 2 | 3 | 4 | 5 | Average | Samples |
| 0.1 | 0.05 | 1.2 | 200 | 200 | 200 | 200 | 200 | 200.0 | 0 |
| 0.2 | 0.10 | 1.1 | 200 | 200 | 200 | 200 | 200 | 200.0 | 0 |
| 0.6 | 0.30 | 0.9 | 200 | 200 | 200 | 200 | 200 | 200.0 | 0 |
| 1.2 | 0.60 | 0.5 | 200 | 200 | 200 | 200 | 200 | 200.0 | 0 |
| 1.4 | 0.70 | 0.4 | 200 | 200 | 200 | 200 | 200 | 200.0 | 0 |
| 1.5 | 0.75 | 0.3 | 200 | 30 | 50 | 200 | 200 | 136.0 | 2 |
| 1.6 | 0.80 | 0.2 | 30 | 50 | 200 | 20 | 30 | 66.0 | 4 |
| 1.8 | 0.90 | 0.1 | 20 | 50 | 30 | 40 | 20 | 32.0 | 5 |
| 2.0 | 1.00 | — | 20 | 30 | 40 | 30 | 40 | 32.0 | 5 |

As shown in Table 1, of the fluorescent lamp samples in which the D2/D1 value was 0.70 or smaller, none of the inter-constituent bridges 70 and the constituent tubes 51 and 61 were damaged, and the average compressive strengths reached 200N, which is the maximum value in these proof tests.

On the contrary, among the fluorescent lamp samples in which the D2/D1 value 0.75 or larger, some of them were damaged before the compression force f2 reached 200N.

Particularly, as for the fluorescent lamp samples in which the D2/D1 value was 0.90 and 1.00 (the constituent tube 51 is parallel with the constituent tube 61), all five of them were damaged.

As shown in Table 1, with respect to the angle θ at which the imaginary line L1 and the imaginary line L2 cross (see FIG. 5), none of the samples that had an angle of 0.4 degrees or larger were damaged. Here, although the maximum value for the angle θ in the tests were 1.2 degrees as shown in the table, it is acceptable to make the angle θ larger than 1.2 degrees for the purpose of keeping the inter-constituent bridge 70 and the constituent tubes 51 and 61 from being damaged. It should be noted, however, in a case of a fluorescent lamp in which the coldest-point method is used to control the vapor pressure, it is desirable to make the angle θ 3.0 degrees or smaller, because it is necessary to keep the D2 defining point of the constituent tube 51 apart from the D2 defining point of the constituent tube 61.

The following explains the compressive strengths, with reference to FIG. 7. Each of the compressive strengths shown in FIG. 7 is an average compressive strength of the five samples at each of the nine D2 levels.

As shown in FIG. 7, for the fluorescent lamp samples in which the D2/D1 value was 0.70 or smaller, the average compressive strength was 200N, which is the maximum value in these proof tests. When the D2/D1 value exceeded 0.70, the compressive strength decreased rapidly.

Also, although tests were not performed, it should be noted that, in fluorescent lamps in which the D2/D1 value is zero, in other words, when the constituent tubes are in contact with each other at the extremity of the lamp, it is assumed that the constituent bridge 70 and the constituent tubes 51 and 61 will not be damaged by the compressive force f2; however, in the fluorescent lamp according to the present invention, the minimum value of D2/D1 is arranged to be 0.05 so that the compactness and the luminous flux of the lamp can be maintained. In other words, since the value of D2/D1 is arranged to be 0.05 or larger, the desirable effects are available wherein (i) the distance between the constituent tubes 51 and 61 is not too large on the base side, (ii) the practicality of the lamp is maintained, and (iii) the external surfaces of the constituent tubes 51 and 61 on the turning portion side are kept apart from each other so that luminous flux remains at a high level.

As seen from the test results above, with regards to a compact fluorescent lamp with such an arrangement, by keeping the value of D2/D1 0.7 or smaller, and preferably keeping it within a range of 0.05 to 0.70 inclusive, it is possible to keep the inter-constituent bridge 70 and the constituent tubes 51 and 61 from being damaged as well as to keep the quantity of light large.

Additionally, when the condition is determined in terms of the angle θ, handleability of the fluorescent lamp is improved when the angle is within a range of 0.4 to 3.0 degrees inclusive.

Other Issues

In the embodiment and the modification example mentioned above, the constituent tubes 10 and 20 are H-shaped; however, the present invention is not limited to H-shaped constituent tubes as long as the constituent tubes each have a U-shaped discharge path. For example, it is acceptable that each constituent tube is bent in a U-shape and has a U-shaped discharge path.

Additionally, in the embodiment and the modification example, the number of constituent tubes included in the fluorescent lamp is two; however, the present invention is not limited to this, and it is acceptable if the number of constituent tubes included in a fluorescent lamp is three or more.

Moreover, in the embodiment and the modification example above, the coldest-point control method is used to control the vapor pressure in the fluorescent lamp; however, it is acceptable to use a fluorescent lamp in which amalgam is enclosed. In such a case, since the lamp luminous flux does not decrease even when D2=0, as explained earlier, the value of D2/D1 may be limited as 0.7 or smaller, and the angle θ may be limited as 0.4 degrees or larger.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A manufacturing method of a fluorescent lamp, comprising:

a hole opening step of opening holes, by melting with heat, each in an area in a vicinity of a first end of a first constituent tube and in an area in a vicinity of a second end of a second constituent tube, the first and second constituent tubes each having a U-shaped discharge path;

a joining step of joining, after the hole opening step is performed, a first melted area formed around the hole in the first constituent tube with a second melted area formed around the hole in the second constituent tube; and a distance adjusting step of adjusting D1 and D2 so that D2/D1 is within a range of 0.05 to 0.70 inclusive, where D1 is a distance between the first melted area in the first constituent tube and the second melted area in the second constituent tube, and D2 is a shortest distance, on a turning portion side of the fluorescent lamp, between the first constituent tube and the second constituent tube, the turning portion being where each U-shaped discharge path turns.

2. The manufacturing method of a fluorescent lamp of claim 1, wherein in the distance adjusting step, (i) a first spacer whose thickness is substantially equal to D1 is inserted between the first constituent tube and the second constituent tube at a point where D1 is measured, and (ii) a second spacer whose thickness is substantially equal to D1 is inserted between the first constituent tube and the second constituent tube at a point where D2 is measured.

3. The manufacturing method of a fluorescent lamp of claim 2, wherein the first spacer and the second spacer are each made of either copper or a copper alloy.

4. The manufacturing method of a fluorescent lamp of claim 1 further including a holding step of holding, after the distance adjusting step is performed, the first and second constituent tubes until the first and second melted areas have a temperature that is equal to or colder than a strain point of a glass material of which the constituent tubes are made.

5. A manufacturing method for a fluorescent lamp having a plurality of tubes cantilevered from a base, comprising;

providing a first and a second set of tubes, each set of tubes having a U-shaped discharge path;

providing an opening on a side of each set of tubes; and interconnecting the side openings on the respective first and second set of tubes with an inter-constituent hollow bridge member that connects a first opening in the first tube on the base side of the fluorescent lamp with a second opening in the second tube on the base side of the fluorescent lamp so as to join the two U-shaped discharge paths, wherein distances between the first tube and the second tube gradually become smaller from the base side of the first and second bridge side of the fluorescent lamp as the first and second tubes extend away from the base, wherein a distance from the first tube at the inter-constituent bridge to the second tube is D1 and a distance from the first tube at a turning point of the U-shaped discharge path to the second tube at a turning point of the U-shaped discharge path is D2 wherein D2/D1 is within a range of 0.05 to 0.70.

* * * * *